United States Patent [19]

Martin

[11] Patent Number: 4,519,613

[45] Date of Patent: May 28, 1985

[54] BADMINTON SHUTTLECOCK

[76] Inventor: Raymond G. Martin, 8160 W. State Street Rd., Winnebago, Ill.

[21] Appl. No.: 583,588

[22] Filed: Feb. 27, 1984

[51] Int. Cl.[3] ..... A63B 67/18

[52] U.S. Cl. ..... 273/417

[58] Field of Search ..... 273/417, 421, 58 D, 273/422; D21/207

[56] References Cited

U.S. PATENT DOCUMENTS

| | | | |
|---|---|---|---|
| 2,212,079 | 8/1940 | Saunders | D21/207 X |
| 2,909,372 | 10/1959 | Neri | 273/422 |
| 4,305,589 | 12/1981 | Popplewell | 273/417 |

FOREIGN PATENT DOCUMENTS

| | | | |
|---|---|---|---|
| 1107136 | 5/1961 | Fed. Rep. of Germany | 273/417 |
| 1156174 | 12/1957 | France | 273/417 |
| 380 | of 1894 | United Kingdom | 273/417 |

*Primary Examiner*—Paul E. Shapiro

[57] ABSTRACT

The striking cap of a badminton shuttlecock is formed as a hollow, truncated sphere having a hole in its outer end and having several holes through its spherical wall to reduce the influence of wind on the flight path of the shuttlecock. The shape of the striking cap also enables the shuttlecock to be better used with damaged racquets without sticking in the torn webbing thereof.

2 Claims, 3 Drawing Figures

BADMINTON SHUTTLECOCK

BACKGROUND OF THE INVENTION

This invention relates to a badminton shuttlecock of the type having a skirt made of feathers or plastic and having a striking cap connected to one end of the skirt.

SUMMARY OF THE INVENTION

The general aim of the present invention is to provide a shuttlecock having a new and improved striking cap which causes the shuttlecock to fly a truer course under high wind conditions and which, at the same time, better adapts the shuttlecock for use with racquets having torn or damaged strings.

A more detailed object is to achieve the foregoing by providing a shuttlecock having a hollow striking cap which is formed with holes permitting air to flow through the cap and decreasing the effect of the wind on the flight of the shuttlecock. The outer end of the striking cap preferably is blunt and lies in a plane perpendicular to the axis of the shuttlecock so as to reduce the possibility of the striking cap sticking in an abnormally enlarged opening of a torn or damaged racquet webbing.

These and other objects and advantages of the invention will become more apparent from the following detailed description when taken in conjunction with the accompanying drawings.

DETAILED DESCRIPTION OF THE PREFERRED EMBODIMENT

Figure 1:
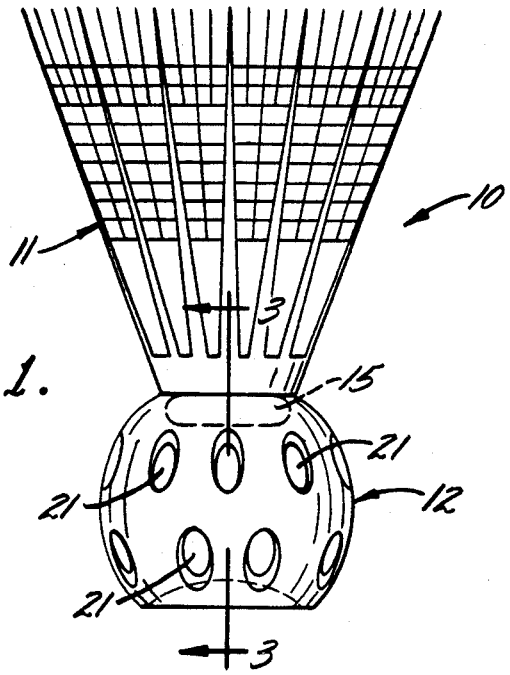
FIG. 1 is a front elevational view of a new and improved shuttlecock incorporating the unique features of the present invention.
Figure 2:
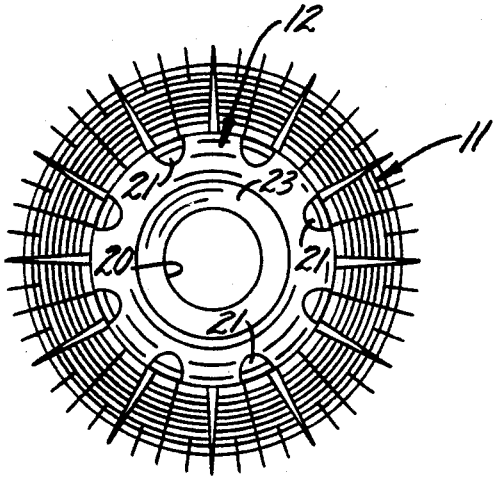
FIG. 2 is a bottom plan view of the shuttlecock shown in FIG. 1.
Figure 3:
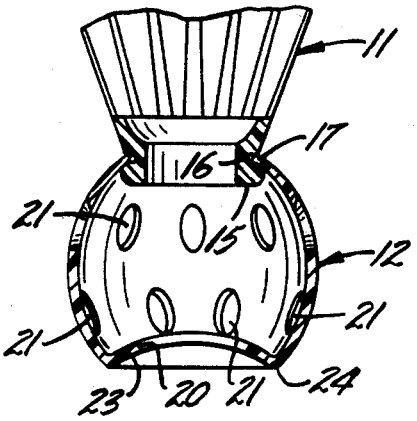
FIG. 3 is a fragmentary cross-section taken substantially along the line 3—3 of FIG. 1.

As shown in the drawings for purposes of illustration, the invention is embodied in a badminton shuttlecock 10 having a generally frustoconical skirt 11 and having a striking cap 12 attached to the smaller end of the skirt. The skirt may be of any conventional construction and either may be made of feathers or molded of plastic. In the present instance, a plastic skirt has been shown.

In accordance with the present invention, the striking cap 12 is of unique construction enabling the shuttlecock 10 to maintain a truer flight course in the presence of wind and better enabling the shuttlecock to be used with damaged racquets having torn strings. Specifically, the striking cap of the invention is a hollow member which is molded of plastic. The striking cap is generally spherical but includes truncated inner and outer ends lying in parallel planes disposed on opposite sides of a plane extending perpendicular to the longitudinal axis of the shuttlecock and through the center of the sphere. The skirt 11 may be attached to the inner end of the striking cap in any suitable manner. As shown, the smaller end of the skirt is formed with a plug-like member 15 which is telescoped snugly into a hole 16 formed in the inner end of the cap 12, the plug-like member being formed with an annular groove 17 which receives and is heat-staked to the plastic at the margin of the hole.

Pursuant to the invention, an axially facing hole 20 is formed in the outer end of the striking cap 12 and allows air to flow into or out of the cap. Moreover, several holes 21 are formed through the spherical portion of the cap so that air may flow through the cap via any of the various holes. As a result, wind has less influence on the shuttlecock 10 and thus the shuttlecock may fly a truer course than a shuttlecock with a solid cap.

The apertured outer end of the striking cap 12 may be formed simply by truncating a hollow sphere. Preferably, however, a generally frustoconical and inwardly tapered depressed surface 23 is formed at the outer end of a truncated sphere with the hole 20 being formed through the center of the depressed surface. The junction between the depressed frustoconical surface and the spherical surface is generously radiused as indicated at 24 so as to avoid sharp edges which might damage the strings of a racquet.

It has been found that a shuttlecock 10 with a striking cap 12 constructed in accordance with the invention is admirably suited for use with a damaged racquet which may have a torn webbing. The radiused end 24 of the cap is relatively blunt and lies in a plane which is perpendicular to the longitudinal axis of the shuttlecock. This construction inhibits the cap entering the openings of the webbing and thus reduces the chances of the cap becoming stuck in an abnormally enlarged opening in a damaged webbing.

I claim:

1. A badminton shuttlecock comprising a generally frustoconical skirt and a striking cap having an inner end attached to the smaller end of said skirt, said striking cap comprising a hollow member made of plastic, said striking cap being shaped generally as a sphere with truncated inner and outer ends, the outer end portion of said striking cap being defined by an inwardly tapered generally frustoconical depressed surface, an opening formed through the center of said surface and communicating with the interior of said cap, and a series of holes formed through the spherical portion of said cap to permit air to flow through said cap.

2. A badminton shuttlecock comprising a generally frustoconical skirt and a striking cap having an inner end attached to the smaller end of said skirt, said striking cap comprising a hollow member made of plastic, the outer end portion of said striking cap being defined by an inwardly tapered generally frustoconical depressed surface, an opening formed through the center of said surface and communicating with the interior of said cap, and a series of holes formed through said cap to permit air to flow through said cap.

* * * * *